United States Patent [19]

Stephenson et al.

[11] Patent Number: 4,694,909

[45] Date of Patent: Sep. 22, 1987

[54] RISER SUPPORT SYSTEM

[75] Inventors: Graham W. Stephenson, Loughton; Richard C. Toft, London, both of England

[73] Assignee: The British Petroleum Company p.l.c., London, England

[21] Appl. No.: 873,876

[22] Filed: Jun. 12, 1986

Related U.S. Application Data

[63] Continuation of Ser. No. 573,311, Jan. 24, 1984, abandoned.

[30] Foreign Application Priority Data

Jan. 27, 1983 [GB] United Kingdom ..... 8302292

[51] Int. Cl.[4] ..... E21B 7/12

[52] U.S. Cl. ..... 166/359; 166/367; 175/7

[58] Field of Search ..... 166/345, 355, 359, 352, 166/367; 175/7

[56] References Cited

U.S. PATENT DOCUMENTS 3,983,706 10/1976 Kalinowski ..... 166/367
3,984,990 10/1976 Jones ..... 175/7
3,996,755 12/1976 Kalinowski ..... 166/355
4,194,568 3/1980 Burési et al. ..... 166/340

FOREIGN PATENT DOCUMENTS 2001034 1/1979 United Kingdom .
2066258 7/1981 United Kingdom .

*Primary Examiner*—Stephen J. Novosad
*Assistant Examiner*—William P. Neuder
*Attorney, Agent, or Firm*—Morgan & Finnegan

[57] ABSTRACT

An off-shore floating oil production system is provided with an improved riser support.

The oil production system comprises a floating vessel 2 having a moonpool 3 and a support system for supporting a riser 16 running through the moonpool 3. The support system comprises guides 7 in the moonpool 3, a carriage 6 which runs on the guides 7 and means 11 for supporting the carriage 6 which contains a pivoted support (12,13) for the riser 16. Means 17 are also provided for permitting rotation between a section of the riser 16 and the carriage 6.

Vertical movement of the carriage compensates for heaving of the vessel, movement of the pivoted support for pitching and rolling and movement of the rotatable means for "weathervaning".

6 Claims, 5 Drawing Figures

RISER SUPPORT SYSTEM

This is a continuation of co-pending application Ser. No. 573,311, filed Jan. 24, 1984, now abandoned.

This invention relates to an offshore oil production system.

GB No. 2066758-A discloses an oil production system suitable for use at an offshore location comprising a floating storage vessel to receive the produced oil and having means for dynamic positioning and a riser supported from the vessel and connectable at its lower end to a subsea well head, the vessel further having means for separating the oil and its associated gas and employing the latter as fuel to power the dynamic positioning means.

Another system has been described which comprises a floating vessel without integral storage facilities, e.g. a semisubmersible rig, which supports a riser connected at its lower end to a subsea well head.

In both systems it is necessary to support the riser from the vessel with the correct amount of tension. In addition, there is a further problem. Since the riser in use is connected to a well head on the sea bed and the supporting vessel is not, movement of the sea can cause relative movement between the riser and the vessel. The riser support system should therefore be able to compensate for this motion.

It is an object of the present invention to provide an oil production system including an improved riser support.

Thus according to the present invention there is provided an oil production system comprising:

(a) a floating vessel having a moonpool, (b) a support system for supporting a riser running through the moonpool, and (c) a riser adapted to be supported by (b); the support system (b) comprising:

(d) guides in the moonpool, (e) a carriage adapted to run on the guides, the guides being fixed to the vessel so as to prevent relative rotation between the carriage and the vessel, and (f) means for supporting the carriage; the carriage (e) comprising:

(g) a pivoted support for the riser, capable of pivoting about more than one axis; the oil production system also comprising:

(h) means for permitting relative rotation about a vertical axis between at least a section of the riser and the carriage.

The riser is preferably a rigid riser.

It may be adapted for support by connecting it to a bracket which rests upon the pivoted support.

The pivoted support may take the form of gimbals.

The carriage is preferably supported by conventional riser tensioners.

Relative rotation between a section of the riser and the carriage may be achieved by fitting a swivel piece into the riser.

A system according to the present invention is very suitable for incorporating into the oil production system disclosed in GB No. 2066758-A.

Figure 1:
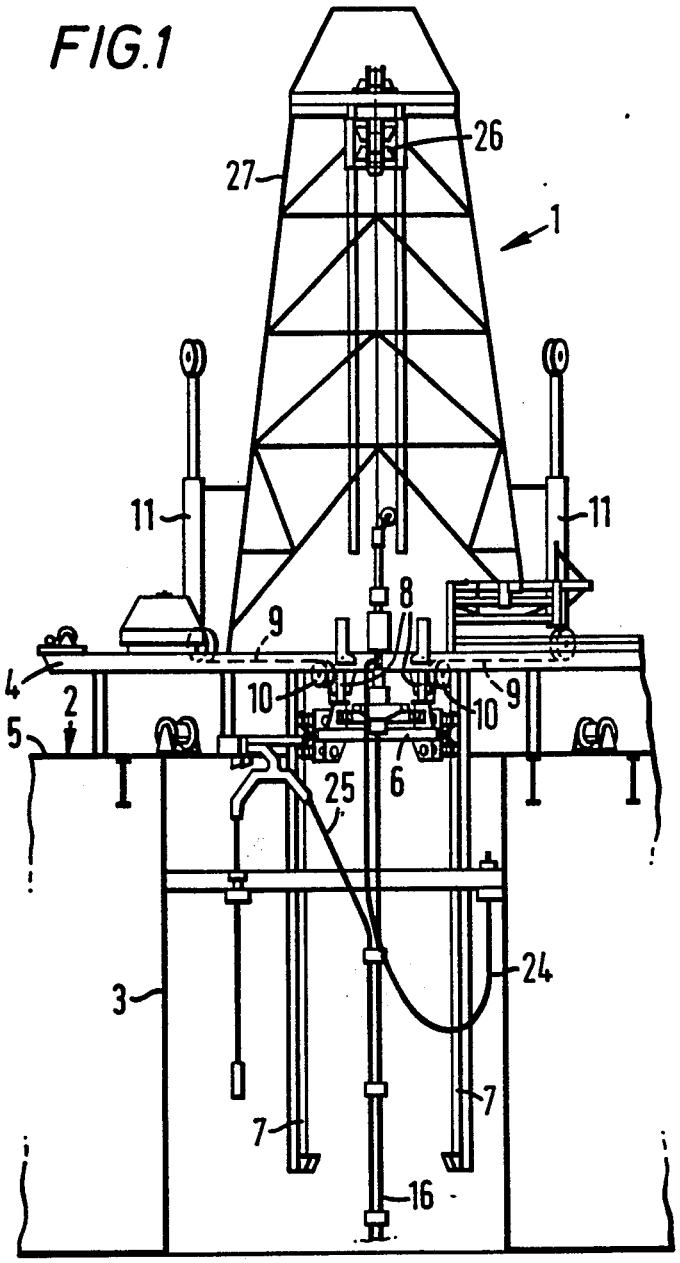
Figure 2:
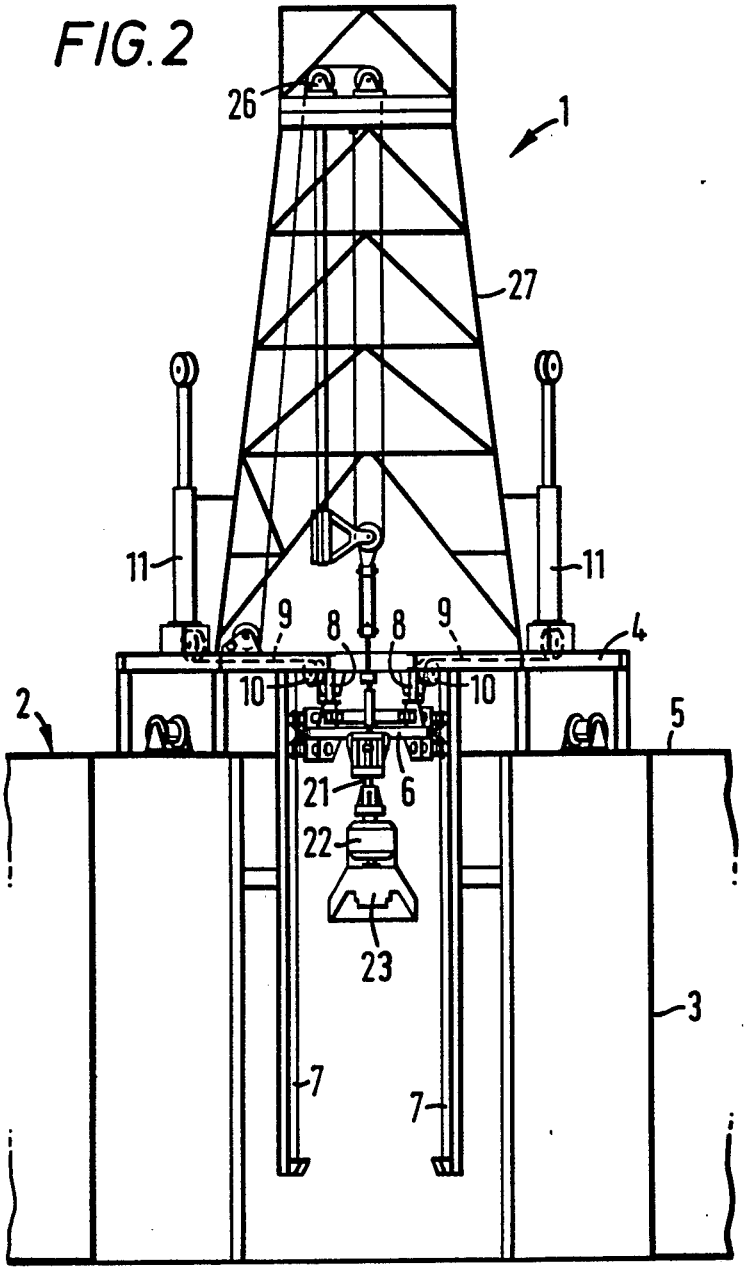
Figure 3:
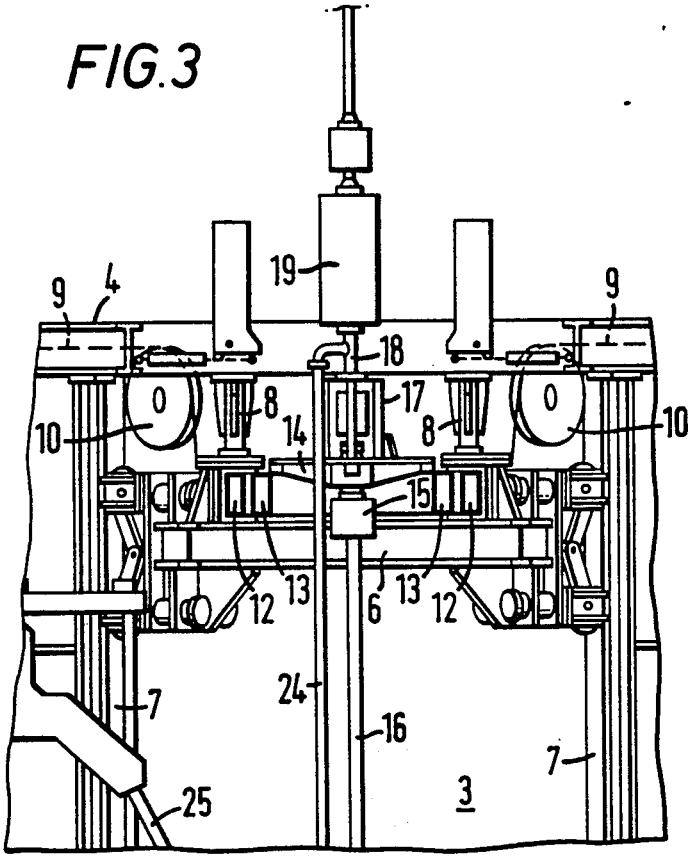
Figure 4:
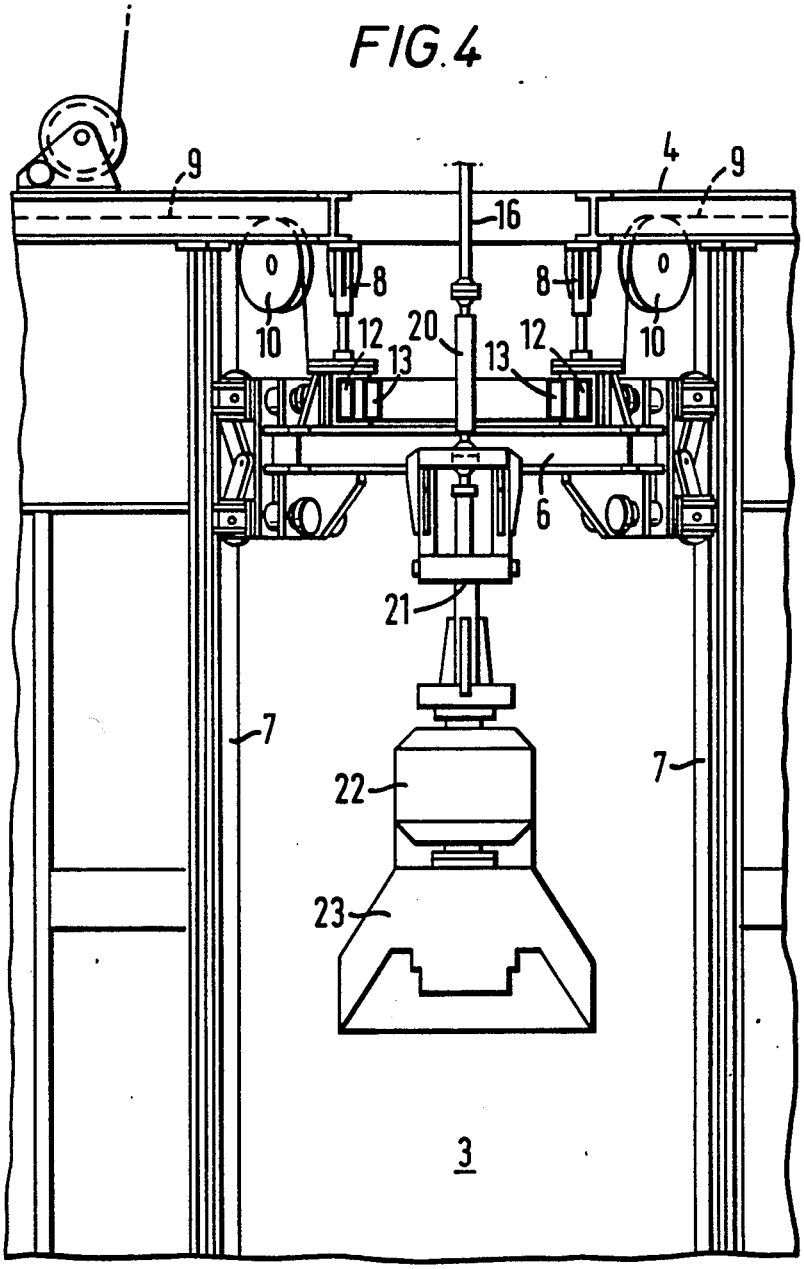
Figure 5:
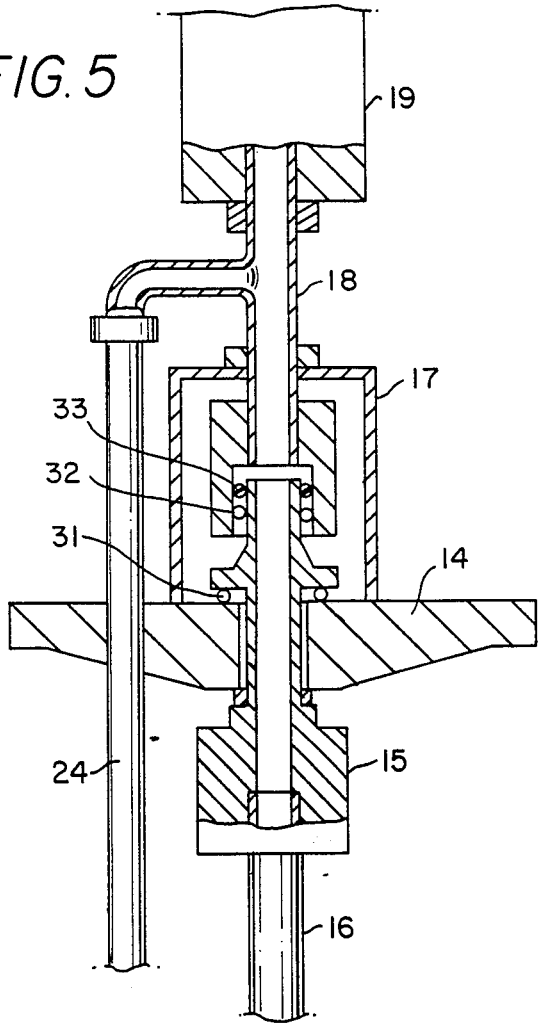

The invention is illustrated with reference to FIGS. 1–4 of the accompanying drawings, wherein FIG. 1 is a section of a segment of a floating single oil well production system incorporating a moveable carriage looking portside, FIG. 2 is a section of the segment looking forward and FIGS. 3 and 4 are details of FIGS. 1 and 2, respectively, FIG. 5 is a detail section of the central portion of FIG. 3.

In FIG. 1, the riser extends towards a well head on the sea bed but is not yet connected. In FIG. 2 the riser is disconnected and the riser connector package has been raised from the well head.

The oil producing system 1 is mqunted on a ship 2 having a moonpool 3. The system has its own working deck 4 which is above the ship's main deck 5.

The riser support means comprises a square carriage 6 which runs on four vertical rails 7 extending from a position near the base of the moonpool 3 to the working deck 4. Recoil cylinders 8 are provided to prevent overtravel of the carriage 6.

The carriage 6 is supported by cables 9 which pass over sheaves 10 to riser tensioners 11 mounted on the working deck 4.

The carriage 6 is fitted with two concentric rings 12 and 13 which are rectangular in cross-section. These are pivotally connected to the carriage and each other to provide a gimbals support.

A bracket 14 rests on the gimbals. Below the bracket is fitted a connecting piece 15 which connects the bracket to a riser 16. Above the bracket is fitted a swivel piece 17, a T-piece 18, and a valve block 19. The riser leads down to the well-head on the sea bed (not shown) and at its base it is connecteed by way of a safety joint 20 and a universal joint 21 to a Lower Riser Package (LRP) 22, which is a system of control valves. The LRP is connected to a Riser Connector Package (RCP) 23 which is connectable to a re-entry hub (REH), not shown, on the well-head.

Oil produced from the well is led up through the RCP 23 the LRP 22, the joints 20 and 21, the riser 16, the swivel 17, and into the T-piece 18 which is connected to a flexible hose 24. The oil is taken by the hose to separators (not shown) for degassing and storage.

An umbilical 25 supplies hydraulic fluid to control the operation of the LRP 22 and RCP 23.

FIGS. 1 and 3 show the system with the riser carriage locked in its upper position. This would be the position used prior to connecting the RCP to the REH. When connecting the RCP 23 to the REH, the carriage 6 travels down approximately to the mid-position on the rails. Thereafter the carriage 6 is normally positioned near this location.

FIG. 4 shows the carriage 6 at the normal upper extremity of its travel range. In this position, the riser has been disconnected and the LRP 22 and RCP 23 raised by a hoist 26 on the derrick 27.

As shown in FIG. 5, the riser 16 and connecting piece 15 remains fixed whilst the swivel 17 and piece 18 attached thereto, rotates. Provision for rotation is made by bearings 31 and 32 and seal 33.

The carriage acts to centralise the riser in the moonpool and to tension it. Vertical movement of the carriage compensates for heaving of the vessel, movement of the gimbals support for riser angle variations and pitching and rolling, and movement of the swivel piece for "weathervaning".

Although the carriage laterally restrains the riser, it, together with universal joint, provides a safety margin for some lateral movement of the vessel, sufficient to give time for the RCP to be disconnecteed from the REH in an emergency.

We claim:

1. An oil production system comprising:

(a) a floating vessel having a moonpool, (b) a support system for supporting a riser running through the moonpool, and (c) a riser adapted to be supported by (b); the support system (b) comprising;

(d) guides in the moonpool, (e) a carriage adapted to run on the guides, the guides being fixed to the vessel so as to prevent relative rotation between the carriage and the vessel, and (f) means for supporting the carriage the carriage (e) comprising:

(g) a pivoted support for the riser, capable of pivoting about more than one axis; the oil production system also comprising:

(h) means for permitting relative rotation about a vertical axis between at least a section of the riser and the carriage.

2. An oil production system according to claim 1 wherein the riser is a rigid riser.

3. An oil production system according to claim 1 wherein the riser is adapted for support by connecting it to a bracket which rests on the pivoted support.

4. An oil production system according to claim 1 wherein the pivoted support is provided by gimbals.

5. An oil production system according to claim 1 wherein the means for supporting the carriage comprises riser tensioners.

6. An oil production system according to claim 1 wherein the means for permitting relative rotation about a vertical axis between at least a section of the riser and the carriage is a swivel piece.

* * * * *